US010342254B2

(12) United States Patent
Nappi et al.

(10) Patent No.: US 10,342,254 B2
(45) Date of Patent: Jul. 9, 2019

(54) IMPERMEABLE BEAD IN HOLLOW CIGARETTE FILTER TUBE

(71) Applicant: PHILIP MORRIS PRODUCTS S.A., Neuchatel (CH)

(72) Inventors: Leonardo Nappi, Hauterive (CH); Clement Besso, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 14/440,646

(22) PCT Filed: Dec. 17, 2013

(86) PCT No.: PCT/EP2013/077004
§ 371 (c)(1),
(2) Date: May 5, 2015

(87) PCT Pub. No.: WO2014/102095
PCT Pub. Date: Jul. 3, 2014

(65) Prior Publication Data

US 2015/0296877 A1 Oct. 22, 2015

(30) Foreign Application Priority Data

Dec. 31, 2012 (EP) ..... 12199823

(51) Int. Cl.
*A24D 3/04* (2006.01)

(52) U.S. Cl.
CPC ..... *A24D 3/04* (2013.01); *A24D 3/043* (2013.01); *A24D 3/045* (2013.01)

(58) Field of Classification Search
CPC ..... A24D 3/0216; A24D 3/04; A24D 3/043
See application file for complete search history.

(56) References Cited

U.S. PATENT DOCUMENTS 6,918,867 B2 7/2005 Scherbarth et al.
7,243,659 B1 * 7/2007 Lecoultre ..... A24C 5/476 131/331

(Continued)

FOREIGN PATENT DOCUMENTS

CN 101562998 A 10/2009
CN 101715305 A 5/2010

(Continued)

OTHER PUBLICATIONS

"More Innovation from CTC", Aug./Oct. 2002, RYO Magazine, vol. III, No. 3, accessed at ryomagazine.com on Oct. 27, 2016.*

(Continued)

*Primary Examiner* — Anthony Calandra
*Assistant Examiner* — Jamel M Nelson
(74) *Attorney, Agent, or Firm* — Oblon, McClelland, Maier & Neustadt, L.L.P.

(57) ABSTRACT

There is provided a filter for a smoking article, the filter including a hollow tube of filter material having an outer diameter and an inner diameter. The filter further includes a flow restrictor disposed in the hollow tube. At least one cross sectional dimension of the flow restrictor is larger than the inner diameter of the hollow tube, such that the flow restrictor engages with the hollow tube to retain the flow restrictor in the hollow tube. There is also provided a smoking article including such a filter.

14 Claims, 1 Drawing Sheet

(56) References Cited

U.S. PATENT DOCUMENTS

| | | | | |
|---|---|---|---|---|
| 2005/0066982 | A1 | 3/2005 | Clark et al. | |
| 2007/0235050 | A1 | 10/2007 | Li et al. | |
| 2008/0216848 | A1* | 9/2008 | Li | A24C 5/475 131/94 |
| 2008/0302373 | A1 | 12/2008 | Stokes et al. | |
| 2010/0108085 | A1* | 5/2010 | Duke | A24D 3/04 131/339 |
| 2010/0294290 | A1 | 11/2010 | Zhang | |
| 2011/0100388 | A1 | 5/2011 | Li et al. | |
| 2011/0190105 | A1 | 8/2011 | Fallon | |
| 2011/0232659 | A1 | 9/2011 | Ercelebi et al. | |
| 2012/0037172 | A1* | 2/2012 | Allen | A24D 3/04 131/275 |

FOREIGN PATENT DOCUMENTS

| | | | | |
|---|---|---|---|---|
| EP | 0 649 607 | A2 | 4/1995 | |
| EP | 1 397 967 | A1 | 3/2004 | |
| FR | 2345092 | A1 | 10/1977 | |
| FR | 2345092 | A1 * | 10/1977 | A24D 3/045 |
| JP | S53-046400 | U | 9/1976 | |
| JP | S54-089400 | U | 12/1977 | |
| JP | 2010-520755 | A | 6/2010 | |
| WO | 2005/077521 | A1 | 8/2005 | |
| WO | WO 2006/117697 | A1 | 11/2006 | |
| WO | 2007/010407 | A2 | 1/2007 | |
| WO | 2007-110650 | A1 | 10/2007 | |
| WO | WO 2008/059377 | A2 | 5/2008 | |
| WO | 2010/133334 | A1 | 11/2010 | |
| WO | 2011/117743 | A1 | 9/2011 | |
| WO | WO 2012/156705 | A1 | 11/2012 | |
| WO | 2013-000967 | A1 | 1/2013 | |

OTHER PUBLICATIONS

Extended European Search Report dated Aug. 5, 2013 in Patent Application No. 12199823.1.

International Search Report dated Jun. 25, 2014 in PCT/EP2013/077004 filed Dec. 17, 2013.

Japanese Office Action with English translation dated Sep. 27, 2017 in corresponding Japanese Patent Application No. 2015-550027, (12 pages).

Combined Office Action and Search Report dated Mar. 22, 2018, in Chinese Patent Application No. 201380067945.9 (with English-language translation), 18 pages.

Combined Office Action and Search Report dated Mar. 22, 2018 in Chinese Patent Application No. 201380067945.9 (with English translation), (previously filed on May 1, 2018), 18 pages.

Jianai, H. "Tobacco Industry Handbook", Yancao Gongye Shouce, Apr. 30, 1999, 5 pages.

* cited by examiner

IMPERMEABLE BEAD IN HOLLOW CIGARETTE FILTER TUBE

CROSS REFERENCE TO RELATED APPLICATION

This application is a U.S. national phase application under 35 U.S.C. § 371 of PCT/EP2013/077004, filed on Dec. 17, 2013, and claims the benefit of priority under 35 U.S.C. § 119 from prior EP Application No. 12199823.1, filed on Dec. 31, 2012, the entire contents of each of which are incorporated herein by reference.

The present invention relates to a filter for a smoking article, and a smoking article comprising a filter.

Combustible smoking articles, such as cigarettes, generally comprise shredded tobacco (usually in cut filler form) surrounded by a paper wrapper forming a tobacco rod. A cigarette is employed by a consumer by lighting one end thereof and burning the shredded tobacco rod. The consumer then receives mainstream smoke by drawing on the opposite end (mouth end or filter end) of the cigarette. The shredded tobacco can be a single type of tobacco or a blend of two or more types of tobacco.

A number of smoking articles in which an aerosol forming substrate, such as tobacco, is heated rather than combusted have also been proposed in the art. In heated smoking articles, the aerosol is generated by heating the aerosol forming substrate. Known heated smoking articles include, for example, smoking articles in which an aerosol is generated by electrical heating or by the transfer of heat from a combustible fuel element or heat source to an aerosol forming substrate. During smoking, volatile compounds are released from the aerosol forming substrate by heat transfer from the heat source and entrained in air drawn through the smoking article. As the released compounds cool they condense to form an aerosol that is inhaled by the consumer. Also known are smoking articles in which a nicotine-containing aerosol is generated from a tobacco material, tobacco extract, or other nicotine source, without combustion, and in some cases without heating, for example through a chemical reaction.

Smoking articles, particularly cigarettes, generally comprise a filter aligned in end-to-end relationship with a source of material, such as a tobacco rod or another aerosol forming substrate. Typically, the filter includes a plug of cellulose acetate tow attached to the tobacco rod or substrate by tipping paper. Ventilation of mainstream smoke can be achieved with a row or rows of perforations in the tipping paper about a location along the filter.

Ventilation may reduce both the particulate phase and the gas phase constituents of the mainstream smoke. However, smoking articles having high levels of ventilation may have levels of resistance-to-draw (RTD) which are too low to be considered acceptable to a consumer. The inclusion of, for example, one or more high density cellulose acetate filter segments may be used to increase to an acceptable level the overall RTD of smoking articles with high ventilation. However, high density cellulose acetate filter segments typically reduce particulate phase (for example, tar) deliveries while having little or no effect on gas phase (for example, carbon monoxide) deliveries. One way to solve this is to include a restrictor element in the filter. For example, WO-A-2010/133334 and US-A-2007/0235050 describe restrictor elements which increase RTD without filtering the smoke. If used with high ventilation, a restrictor element can increase RTD while both the particulate phase and the gas phase constituents of the mainstream smoke are reduced.

It would be desirable to provide a filter for a smoking article having an improved flow restricting element which is straightforward and inexpensive to manufacture.

According to a first aspect of the invention, there is provided a filter for a smoking article, the filter comprising: a hollow tube of filter material, the hollow tube having an outer diameter and an inner diameter; and a flow restrictor disposed in the hollow tube, wherein at least one cross sectional dimension of the flow restrictor, in a direction perpendicular to the longitudinal axis of the hollow tube, is larger than the inner diameter of the hollow tube such that the flow restrictor engages with the hollow tube to retain the flow restrictor in the hollow tube, and wherein the flow restrictor is adapted to divert flow of smoke between the restrictor and the outer diameter of the hollow tube.

The flow restrictor requires less material than many prior art restrictor elements. This reduces the weight and cost of the flow restrictor. The filter according to the invention provides flexibility for shorter filter designs, since the flow restrictor increases the RTD in a relatively short filter length. This is particularly advantageous since it may allow the filter to be manufactured using less filter material. Depending on the specifics of the design, the flow restrictor may be easy to produce without the need for injection moulding. This may mean that the flow restrictor is quicker, easier and cheaper to manufacture than many prior art restrictor elements.

By adapting the flow restrictor to divert flow of smoke between the restrictor and the outer diameter of the hollow tube, air and smoke drawn through the filter are forced to flow around the flow restrictor and through a reduced cross section of filter material of the hollow tube. In particular, air and smoke drawn through the filter are forced between the outer surface of the flow restrictor and the outer diameter of the hollow tube. This means that the filtration material circumscribing the flow restrictor can not only help to retain the restrictor in place, but can also act as a filtration medium for smoke flowing around the restrictor.

Thus, the flow restrictor reduces the permeable cross-sectional area of the filter. Preferably, the cross-sectional area of the flow restrictor is between about 35% and about 90% of the cross-sectional area of the filter segment. That is, preferably, the permeable cross-sectional area of the filter is between about 10% and about 65% of the cross-sectional area of the filter segment. This increases the RTD of the filter to a level which is acceptable to a consumer. Although the flow restrictor may comprise air-impermeable material, this does not preclude the flow restrictor having a shape which includes one or more air flow channels. In some cases the flow restrictor diverts all or substantially all of the smoke and air from flowing through the central portion of the filter, while in other cases the flow restrictor may force most of the smoke and air around the flow restrictor while still allowing a small amount of smoke and air through the restrictor element, for example through one or more channels in the flow restrictor.

Diverting the flow to the edge of the filter may be particularly effective in increasing RTD since flow of air or smoke or both air and smoke may be predominantly through the central portion of the filter. The size and shape of the flow restrictor and the type of filter material of the hollow tube may be selected to affect the RTD in a desired manner. For example, when placed in a single filter segment without ventilation, the flow restrictor may be able to generate a RTD in the range of approximately 200 mm $H_2O$ (about 1960 Pa) to approximately 500 mm $H_2O$ (about 4900 Pa). Preferably, the flow restrictor is able to generate a RTD between approximately 250 mm $H_2O$ (about 2450 Pa) and approximately 400 mm $H_2O$ (about 3920 Pa). The term "air-impermeable material" is used throughout this specification to mean a material not allowing the passage of fluids, particularly air and smoke, through interstices or pores in the material.

Preferably, the material of the flow restrictor is impermeable to air and smoke. That is, preferably the flow restrictor comprises an air-impermeable material. The term "air-impermeable material" is used throughout this specification to mean a material not allowing the passage of fluids, particularly air and smoke, through interstices or pores in the material. This can further enhance the diversion of the flow of smoke and air around the flow restrictor. Downstream of the flow restrictor, however, the inventors have found that the air and smoke tend to return to a flow path predominantly in the centre of the filter, since the path of least resistance is through the lumen of the hollow tube, rather than through the filter material of the hollow tube. Because of this, the centrally focussed smoke flow may cause staining of the centre of any filter elements downstream of the flow restrictor. Therefore, preferably, the filter forms a mouth end cavity. The filter may be open or hollow or tubular at the mouth end. By forming a mouth end cavity in the filter, visible, unsightly staining of the mouth end by the focussed smoke flow can be reduced.

The mouth end cavity may be provided by the hollow tube itself or by an additional tubular element disposed downstream of the hollow tube. Preferably, the mouth end cavity is formed from the mouth end of the filter to the downstream end of the flow restrictor. In such an example, the hollow tube itself may form a part of the mouth end cavity. This may allow at least a portion of the flow restrictor to be visible to a consumer from the mouth end. Alternatively, one or more plugs or discs may be provided between the downstream end of the hollow tube and the downstream end of the filter.

If one or more plugs or discs are provided between the downstream end of the hollow tube and the downstream end of the filter, various measures may be taken to reduce visible staining of such plugs or discs. For example, the one or more plugs or discs may be positioned close to the downstream end of the flow restrictor, where the smoke flow is relatively dispersed. In this case, the upstream end of the one or more plugs or discs is preferably less than about 8 mm from the downstream end of the flow restrictor, more preferably less than about 4 mm from the downstream end of the flow restrictor, and even more preferably less than about 2 mm from the downstream end of the flow restrictor. In some embodiments, the upstream end of the one or more plugs or discs is about 0 mm from the downstream end of the flow restrictor.

Alternatively or additionally, the one or more plugs or discs may be relatively short in length to reduce the amount of material through which the smoke flows. In this case, each of the one or more plugs or discs preferably has a length of less than about 4 mm, more preferably less than about 2 mm, and even more preferably less than about 1 mm. In some embodiments, each of the one or more plugs or discs has a length of at least about 0.2 mm. In embodiments in which each of the one or more plugs or discs has a length of less than about 2 mm, the one or more plugs or discs may be formed from a non-woven mesh material.

Alternatively or additionally, the one or more plugs or discs may be spaced sufficiently far upstream of the mouth end of the filter such that the visibility of any staining of such plugs or discs is reduced. In this case, preferably the downstream end of the one or more plugs or discs is at least about 4 mm from the mouth end of the filter, more preferably at least about 6 mm from the mouth end of the filter, and even more preferably at least about 8 mm from the mouth end of the filter. Downstream of the one or more plugs or discs the filter may form a mouth end cavity.

In this specification, the terms "upstream" and "downstream" are used to describe relative positions between elements of the filter or smoking article in relation to the direction of mainstream smoke as it is drawn from a lit end of the smoking article through the filter.

The flow restrictor may have any suitable shape. The at least one cross sectional dimension of the flow restrictor, which is larger than the inner diameter of the hollow tube, ensures that the flow restrictor engages with the hollow tube, so as to be retained in the hollow tube.

The flow restrictor may be solid or may include one or more air flow channels or may comprise a shell and a core. If the flow restrictor comprises a core and shell structure, the core may be empty. In some embodiments, the flow restrictor may include one or more air flow channels through the flow restrictor so that some of the air and smoke drawn through the filter is not forced around the flow restrictor. In preferred embodiments, the flow restrictor forms a solid barrier comprising air-impermeable material to force the flow of smoke and air around the flow restrictor, as discussed herein. The flow restrictor may be manufactured using a fast continuous process such as a rotary-die process.

For example, the flow restrictor may be substantially cylindrical, prism-shaped, ovoid, ellipsoid, spheroid, conical, or teardrop-shaped. Preferably, the flow restrictor is a flow restricting bead. Preferably, the flow restrictor is a flow restricting ball. Preferably, the flow restrictor is substantially spherical. This may include flow restrictors having a sphericity value of at least about 0.9, and preferably a sphericity value of approximately 1. Sphericity is a measure of how spherical an object is, with a perfect sphere having a sphericity value of 1. A spherical flow restrictor is easy to manufacture. In addition, the spherical shape allows easy insertion of the flow restrictor into the hollow tube of filter material. In addition, since a sphere is radially symmetric, the same RTD may be obtained regardless of the orientation that the flow restrictor adopts in the hollow tube. This may simplify the process of assembling the filter.

Irrespective of the shape of the flow restrictor, at least one cross sectional dimension of the flow restrictor is larger than the inner diameter of the hollow tube such that the flow restrictor is retained in the hollow tube. Static friction resists relative lateral motion between the flow restrictor and the inner surface of the hollow tube when the flow restrictor is within the hollow tube. Static friction therefore prevents the flow restrictor being dislodged from the hollow tube after insertion. The size and shape of the flow restrictor may be selected to provide the desired level of static friction between the flow restrictor and the hollow tube. If the flow restrictor is a sphere, the at least one cross sectional dimension is preferably the diameter of the sphere. The at least one cross sectional dimension is measured when the flow restrictor is disposed in the hollow tube, with the measurement being taken perpendicular to the longitudinal axis of the hollow tube between the two points of the flow restrictor furthest from one another. The two points that are furthest from one another may be at the same longitudinal position along the hollow tube, or they may be at different longitudinal positions.

The flow restrictor may also have a second cross sectional dimension which is smaller than the inner diameter of the hollow tube. Preferably, the second cross sectional dimension is the leading portion as the flow restrictor is inserted into the hollow tube, which may facilitate the insertion.

Preferably, only a single flow restrictor is disposed in the hollow tube. However, additional flow restrictors may be provided. If additional flow restrictors are provided in the filter, they may have the same or different properties as one another.

Preferably, the hollow tube has an outer diameter $D_O$ between about 3.8 mm and about 9.5 mm. More preferably, the hollow tube has an outer diameter $D_O$ between about 4.6 mm and about 7.8 mm. Even more preferably, the hollow tube has an outer diameter $D_O$ of about 7.7 mm. The inner diameter $D_I$ of the hollow tube is the diameter of the lumen of the hollow tube. Preferably, the inner diameter $D_I$ of the hollow tube is between about 50% and about 90% of the outer diameter $D_O$. More preferably, the inner diameter $D_I$ is between about 60% and about 80% of the outer diameter $D_O$. Even more preferably, the inner diameter $D_I$ is between about 60% and about 70% of the outer diameter $D_O$. Even more preferably, the inner diameter $D_I$ is about 69% of the outer diameter $D_O$. Preferably, $D_O-D_I>$about 0.5 mm in order for sufficient structural integrity of the tube. In a preferred embodiment, the inner diameter $D_I$ of the hollow tube is about 5.3 mm. Most preferably, the outer diameter $D_O$ is about 7.7 mm and the inner diameter $D_I$ is about 5.3 mm. The inner diameter and outer diameter of the hollow tube are measured perpendicular to the longitudinal axis of the filter and the smoking article. Preferably, the at least one cross sectional dimension of the flow restrictor is measured in the direction of the inner and outer diameters of the hollow tube, that is perpendicular to the longitudinal axis of the filter and the smoking article.

The size and shape of the flow restrictor relative to the outer diameter of the hollow tube may be selected to provide the desired level of RTD. The at least one cross sectional dimension of the flow restrictor may be between about 60% and about 95% of the outer diameter of the hollow tube. If the flow restrictor and hollow tube have circular cross sections, this corresponds to the permeable cross sectional area being reduced by the flow restrictor to between about 10% and about 64% of cross sectional area of the hollow tube. Preferably, the at least one cross sectional dimension of the flow restrictor is between about 70% and about 90% of the outer diameter of the hollow tube. If the flow restrictor and hollow tube have circular cross sections, this corresponds to the permeable cross sectional area being reduced by the flow restrictor to between about 19% and about 51% of cross sectional area of the hollow tube. More preferably, the at least one cross sectional dimension of the flow restrictor is between about 70% and about 80% of the outer diameter of the hollow tube. If the flow restrictor and hollow tube have circular cross sections, this corresponds to the permeable cross sectional area being reduced by the flow restrictor to between about 36% and about 51% of cross sectional area of the hollow tube. Even more preferably, the at least one cross sectional dimension of the flow restrictor is between about 72% and about 78% of the outer diameter of the hollow tube. If the flow restrictor and hollow tube have circular cross sections, this corresponds to the permeable cross sectional area being reduced by the flow restrictor to between about 39% and about 48% of the cross sectional area of the hollow tube.

The at least one cross sectional dimension of the flow restrictor may be between about ($D_O$−3.0 mm) and about ($D_O$−0.2 mm). Even more preferably, the at least one cross sectional dimension of the flow restrictor is between about ($D_O$−2.8 mm) and about ($D_O$−0.4 mm). Even more preferably, the at least one cross sectional dimension of the flow restrictor is between about ($D_O$−1.5 mm) and about ($D_O$−0.8 mm). Even more preferably, the at least one cross sectional dimension of the flow restrictor is between about ($D_O$−1.2 mm) and about ($D_O$−1.0 mm). The at least one cross sectional dimension of the flow restrictor may be about ($D_O$−1.73 mm). The at least one cross sectional dimension of the flow restrictor may be about ($D_O$−0.58 mm). In one preferred embodiment, the at least one cross sectional dimension of the flow restrictor is about 5.55 mm. In another preferred embodiment, the at least one cross sectional dimension of the flow restrictor is about 6.0 mm. In another preferred embodiment, the at least one cross sectional dimension of the flow restrictor is about 7.15 mm.

The size and shape of the flow restrictor relative to the inner diameter of the hollow tube may be selected to retain the flow restrictor in the hollow tube by friction. The inner diameter of the hollow tube may be between about 75% and about 99% of the at least one cross sectional dimension of the flow restrictor. Preferably, the inner diameter of the hollow tube is between about 80% and about 95% of the at least one cross sectional dimension of the flow restrictor. Preferably, the inner diameter of the hollow tube is between about 88% and about 95% of the at least one cross sectional dimension of the flow restrictor. In one embodiment, the inner diameter of the hollow tube is about 88% of the at least one cross sectional dimension of the flow restrictor. In another embodiment, the inner diameter of the hollow tube is about 95% of the at least one cross sectional dimension of the flow restrictor.

Preferably, the flow restrictor is non-compressible. The term "non-compressible" is used throughout this specification to mean resistant to compression from any of: manual handling as the smoking article is removed from a pack, digital compression (that is, by a user's fingers on the filter), buccal compression (that is, by a user's lips or teeth on the mouth end of the filter) or the manual extinguishing ("stubbing out") process. That is, the term "non-compressible" is used to mean not deformable or destructible in the normal handling of a smoking article during manufacture and use.

Preferably, the flow restrictor has a compressive yield strength greater than about 8.0 kPa. More preferably, the flow restrictor has a compressive yield strength greater than about 12.0 kPa. The compressive yield strength is defined as the value of uniaxial compressive stress reached when there is a permanent deformation of the flow restrictor.

Preferably, the flow restrictor has a compressive strength at a deformation of 10% greater than about 50.0 kPa. The compressive strength at a deformation of 10% is defined as the value of uniaxial compressive stress reached when there is a 10% deformation (that is, a 10% change in one cross sectional dimension) of the flow restrictor.

A flow restrictor having a compressive yield strength greater than about 8.0 kPa, or more preferably greater than about 12.0 kPa, or a compressive strength at a deformation of 10% greater than about 50.0 kPa, is not easily dislodged from the hollow tube. However, because the at least one cross sectional dimension of the flow restrictor is larger than the inner diameter of the hollow tube, the filter material of the hollow tube must be sufficiently compressible to allow the flow restrictor to be inserted into the hollow tube. The flow restrictor engages with the hollow tube, for example, by resistance created by frictional force between the flow restrictor and the inner surface of the deformable hollow tube, so as to retain the flow restrictor in the hollow tube.

The compressive yield strength and the compressive strength at a deformation of 10% may both be obtained experimentally by means of standardized test ISO 604. As will be appreciated by the skilled person, in this test, the specimen (flow restrictor) is compressed by compressive plates along an axis that corresponds to the pressure that a smokers' fingers would exert on the restrictor when the smoker is grasping the smoking article. The test is conducted at a constant rate of displacement until the load or deformation reaches a predetermined value. The load sustained by the specimen (flow restrictor) is measured during the procedure.

The flow restrictor may comprise any suitable material or materials. Preferably, the flow restrictor comprises one or more air-impermeable materials. Examples of suitable materials include, but are not limited to, gelatin or other types of hydrocolloids, alginate, carboxymethyl cellulose (CMC), cellulose, starch, polylactic acid, poly(butylene succinate) and its copolymers, poly(butylene adipate-co-terephthalate) and combinations thereof. The flow restrictor may comprise compressed tobacco, tobacco dust, ground tobacco, other flavourants or a combination thereof.

Preferably, the flow restrictor is formed from a dissolvable polymeric material formed of one or more water soluble polymers. More preferably the dissolvable polymeric material is formed of one or more water soluble thermoplastics. The term "dissolvable" means that the polymeric material is capable of dissolving into a solution with a water solvent. This is achieved through the use of one or more water soluble materials to form the material. The flow restrictor may be made entirely of the dissolvable polymeric material or the dissolvable polymeric material may be combined with inert components, such as inert inorganic fillers, which may or may not be dissolvable. The use of a dissolvable material to form the flow restrictor advantageously increases the rate of disintegration of the filter after it has been discarded. Alternatively or additionally, the flow restrictor may comprise a material which disperses into a suspension or colloid with the addition of water.

More preferably, the flow restrictor is formed from a biodegradable polymeric material. Preferred polymers are fully biodegradable as defined in the Aqueous Aerobic Biodegradation Test (Sturm test) outlined in European standard EN13432. Preferred biodegradable polymers include starch.

The filter material of the hollow tube may comprise any suitable material or materials. The type of filter material may be selected to provide the desired level of RTD. Examples of suitable materials include, but are not limited to, cellulose acetate, cellulose, reconstituted cellulose, polylactic acid, polyvinyl alcohol, nylon, polyhydroxybutyrate, thermoplastic material, such as starch, formed into an open cell foam, and combinations thereof. All or part of the filter may include activated carbon. The filter may include an adhesive or plasticiser or a combination thereof to assist with retaining the flow restrictor in the hollow tube. This may also assist with inserting the flow restrictor into the hollow tube during manufacture. The filter material may be compressible, to allow the flow restrictor to be inserted into the hollow tube.

Preferably, the filter material of the hollow tube is of low particulate efficiency. Preferably, the hollow tube comprises fibres of between approximately 1.5 denier per filament (dpf) and approximately 12.0 dpf. In a preferred embodiment, the hollow tube comprises medium diameter fibres of approximately 3.3 dpf. Preferably, the hollow tube comprises fibres of between approximately 15000 total denier (td) and approximately 50000 td. In a preferred embodiment, the hollow tube comprises medium diameter fibres of approximately 44000 td.

The filter may include one or more additional filter elements upstream, downstream or both upstream and downstream of the hollow tube. If the filter includes additional elements, the hollow tube with flow restrictor disposed therein is only a filter component of the smoking article filter, rather than the whole smoking article filter. The additional filter elements may be axially aligned with the hollow tube. For example, the filter may further include a plug or plugs or disc or discs of filter material upstream of the hollow tube, a plug or plugs or disc or discs or filter material downstream of the hollow tube, or plugs or discs of filter material upstream and downstream of the hollow tube. Alternatively or additionally, the filter may further include a tubular element or elements downstream of the hollow tube, a tubular element or elements upstream of the hollow tube, or tubular elements downstream and upstream of the hollow tube. The tubular element or elements may have the same or different dimensions as the hollow tube of filter material. If more than one tubular element is provided, the tubular elements may have the same or different dimensions as each other.

The filter may include a filter wrapper circumscribing at least the hollow tube of filter material. A filter wrapper provides strength and structural rigidity for the hollow tube. This reduces the chance that the hollow tube will deform or be damaged as the flow restrictor is inserted into the hollow tube. This also reduces the chance that the hollow tube will deform on its outer surface around the region where the flow restrictor is disposed inside the hollow tube. Preferably, where the filter includes one or more additional filter elements, the hollow tube and the one or more additional filter elements are overwrapped with a filter wrapper. The filter wrapper may comprise any suitable material. Preferably, the filter wrapper is a stiff plug wrap, for example comprising stiff paper or cardboard. The stiff paper or cardboard preferably has a basis weight greater than about 60 $gm^{-2}$. A stiff filter wrapper provides high structural rigidity. The filter wrapper may include a seam including one or more lines of adhesive. Preferably, the seam includes two lines of adhesive. This reduces the chance that the filter wrapper will split open as the flow restrictor is inserted into the hollow tube. One line of adhesive may comprise a hot melt adhesive. One line of adhesive may comprise polyvinyl alcohol.

Preferably, the filter has a length $L_F$ between about 15 mm and about 40 mm. Even more preferably, the filter has a length $L_F$ between about 18 mm and about 27 mm. In one embodiment, the filter has a length $L_F$ of about 27 mm. In a preferred embodiment, however, the filter has a length $L_F$ of about 21 mm. The reduced length is possible because the design of the filter according to the invention allows the desired RTD to be achieved in a shorter length. This is particularly advantageous because it requires less filter material. If the filter does not include additional filter elements upstream or downstream of the hollow tube, the length of the hollow tube is equal to the length of the filter. If the filter does include additional filter elements upstream or downstream or both upstream and downstream of the hollow tube, the length of the hollow tube is less than the length of the whole filter. The length of the hollow tube will depend on the additional filter element or elements.

In accordance with conventional manufacturing techniques, double length filters may be formed, then the double length filters may be attached to two aerosol forming substrates, one at each end, and then the double length filters may be cut in half, to thereby produce two smoking articles. In that case, the filter length is double that needed for a single smoking article. For example, if the smoking article filter has a length $L_F$ between about 15 mm and about 40 mm, a double length filter may have a length between about 30 mm and about 80 mm. If the smoking article filter has a length $L_F$ between about 18 mm and about 27 mm, a double length filter may have a length between about 36 mm and about 54 mm. If the smoking article filter has a length $L_F$ of about 27 mm, a double length filter may have a length of about 54 mm. If the smoking article filter has a length $L_F$ of about 21 mm, a double length filter may have a length of about 42 mm.

The longitudinal position of the centre of the flow restrictor in the hollow tube may be selected to provide the desired level of RTD. For example, the longitudinal position of the centre of the flow restrictor may be at least about 6 mm from the mouth end of the filter. In this specification, the "centre" of the flow restrictor refers to the mid-point between the part of the flow restrictor disposed closest to the downstream end of the filter and the part of the flow restrictor disposed closest to the upstream end of the filter.

Filters according to the present invention may advantageously be used in filter cigarettes and other smoking articles in which tobacco material is combusted to form smoke. Filters according to the present invention may alternatively be used in smoking articles in which tobacco material is heated, rather than combusted, to form an aerosol. Filters according to the present invention may also be used in smoking articles in which a nicotine-containing aerosol is generated from a tobacco material, tobacco extract, or other nicotine source, without combustion or heating.

According to a second aspect of the invention, there is provided a smoking article comprising: an aerosol forming substrate; and a filter according to the first aspect of the invention. According to a second aspect of the invention, there is provided a smoking article comprising: a tobacco rod; and a filter according to the first aspect of the invention.

Preferably, the smoking article further comprises tipping material attaching the tobacco rod or other aerosol forming substrate and the filter. The tipping material may provide additional strength and structural rigidity for the filter and reduce the chance of deformation on the outer surface of the filter at the location where the flow restrictor is disposed in the hollow tube of filter material. The tipping material may include a ventilation zone comprising perforations through the tipping material. The tipping material may include at least one row of perforations to provide ventilation of the mainstream smoke. If the filter includes a filter wrapper, preferably, the perforations extend through the filter wrapper. Alternatively, the filter wrapper may be permeable. The tipping material may be standard pre-perforated tipping material. Alternatively, the tipping material may be perforated (for example, using a laser) during the manufacturing process according to the desired number, size and position of the perforations. The number, size and position of the perforations may be selected to provide the desired level of ventilation. The ventilation, in conjunction with the flow restrictor and the filter material of the hollow tube, produces the desired level of RTD.

Preferably, the at least one circumferential row of perforations is at least about 1 mm downstream of the centre of the flow restrictor. More preferably, the at least one circumferential row of perforations is at least about 3 mm downstream of the centre of the flow restrictor. Most preferably, the ventilation zone is placed downstream of the flow restrictor such that the ventilation air is introduced into a cavity or a filter element disposed downstream of the flow restrictor. This provides the optimal mix of ambient air drawn through the perforations and the air and smoke mixture flowing through the filter.

A further aspect of the invention is directed to the use of a flow restrictor to restrict air flow in a filter for a smoking article, wherein the flow restrictor is disposed in a hollow tube of filter material having an outer diameter and an inner diameter, wherein at least one cross sectional dimension of the flow restrictor, in a direction perpendicular to the longitudinal axis of the hollow tube, is larger than the inner diameter of the hollow tube such that the flow restrictor engages with the hollow tube to retain the flow restrictor in the hollow tube, and wherein the flow restrictor is adapted to divert flow of smoke between the restrictor and the outer diameter of the hollow tube.

Features described in relation to one aspect of the invention may also be applicable to another aspect of the invention.

The invention will be further described, by way of example only, with reference to the accompanying drawings in which.

Figure 1:
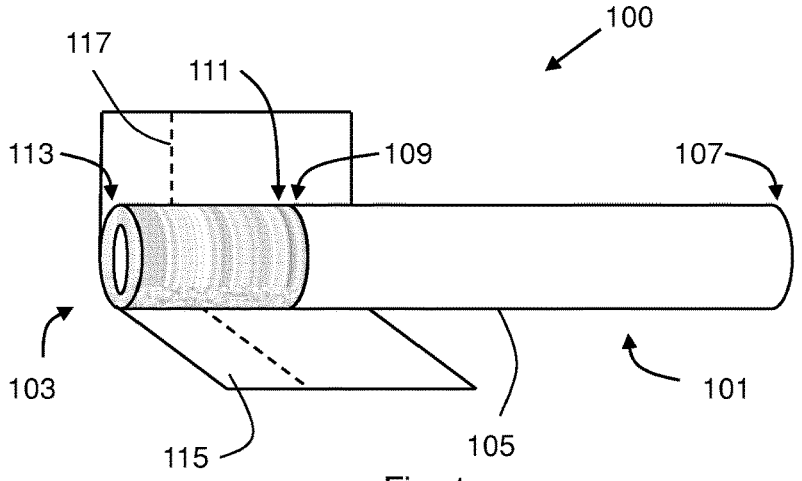
FIG. 1 is a perspective view of a smoking article according to one embodiment of the invention.

FIG. 1 is a perspective view of a smoking article 100 according to one embodiment of the invention. The smoking article 100 includes a generally cylindrical tobacco rod 101 and a generally cylindrical filter 103. The tobacco rod 101 and filter 103 are axially aligned in an end-to-end relationship, preferably abutting one another. The tobacco rod includes an outer wrapper 105 circumscribing the smoking material. The outer wrapper 105 may be a porous wrapping material or paper wrapper. The tobacco is preferably a shredded tobacco or tobacco cut filler. The tobacco rod 101 has an upstream, lit end 107 and a downstream end 109. The filter 103 has an upstream end 111 and a downstream, mouth end 113. The upstream end 111 of the filter 103 is adjacent the downstream end 109 of the tobacco rod 101. Although not visible in FIG. 1, a flow restrictor is disposed in the filter 103.

The filter 103 is attached to the tobacco rod 101 by tipping material 115 which circumscribes the entire length of the filter 103 and an adjacent region of the tobacco rod 101. The tipping material 115 is shown partially removed from the smoking article in FIG. 1, for clarity. The tipping material 115 is typically a paper like product. However, any suitable material can be used. In this embodiment, the tipping material 115 includes a circumferential row of perforations 117 aligned with the filter 103. The perforations are provided for ventilation of the mainstream smoke.

In this specification, the "upstream" and "downstream" relative positions between smoking article components are described in relation to the direction of mainstream smoke as it is drawn from the tobacco rod 101 and through the filter 103.

Figure 2:
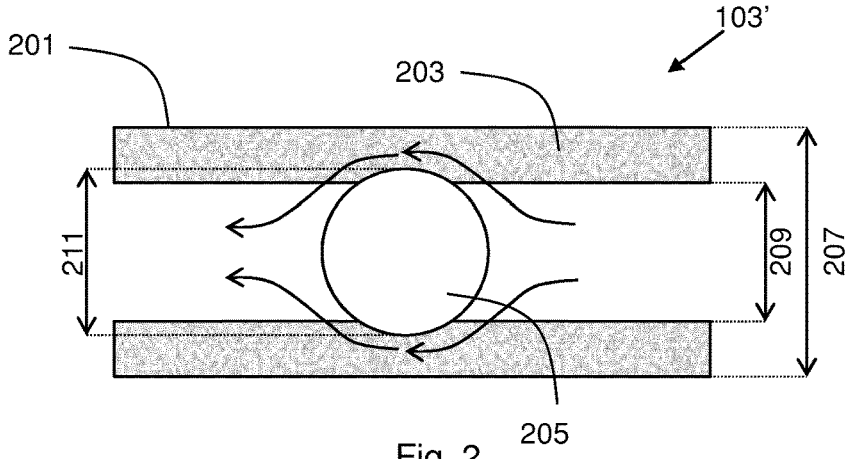
FIG. 2 is a cross sectional view of a filter according to a first embodiment of the invention.

FIG. 2 is a cross sectional view of a filter 103' according to a first embodiment of the invention. The filter 103' may be used in the smoking article of FIG. 1. In FIG. 2, the filter 103' comprises a hollow tube 201 of filter material 203. The hollow tube 201 has an outer diameter 207 and an inner diameter 209. The filter 103' further comprises a flow restrictor, in the form of bead 205. In the embodiment of FIG. 2, the flow restricting bead 205 comprises air-impermeable material. The flow restricting bead 205 is substantially spherical, with a diameter 211. The flow restricting bead 205 is disposed in the hollow tube 201. Diameter 211 of the flow restricting bead 205 is slightly larger than inner diameter 209 of the hollow tube 201, so the flow restricting bead 205 causes the filter material adjacent the bead 205 to distort slightly and the flow restricting bead 205 is retained in the hollow tube 201 by friction. As shown schematically by the arrows, air drawn through the filter 103' during use of the smoking article is forced to flow around the flow restricting bead 205 and through a reduced cross section of filter material 203 of the hollow tube 201. Because the filter 103' is open at the mouth end, thereby forming a mouth end cavity, visible staining of the mouth end is reduced. The filter may be manufactured by inserting the flow restricting bead 205 into the hollow tube 201.

In FIG. 2, the outer diameter 207 of the hollow tube 201 is 7.7 mm, the inner diameter 209 of the hollow tube 201 is 5.3 mm, the diameter of the flow restricting bead 205 is 6.0 mm, the length of the filter 103' is 21 mm and the centre of the flow restricting bead 205 is 11 mm from the downstream end of the filter 103'. When the filter is circumscribed by tipping material, the diameter of the filter may be 7.73 mm.

Figure 3:
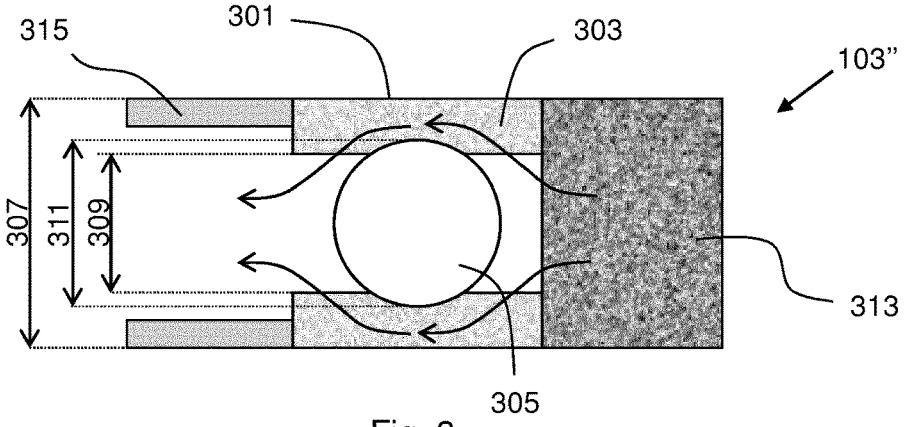
FIG. 3 is a cross sectional view of a filter according to a second embodiment of the invention.

FIG. 3 is a cross sectional view of a filter 103" according to a second embodiment of the invention. The filter 103" may be used in the smoking article of FIG. 1. In the embodiment of FIG. 2, the hollow tube 201 comprises the entire filter 103'. However, in the embodiment of FIG. 3, the filter 103" includes additional elements. Specifically, in FIG. 3, the filter 103" comprises a hollow tube 301 of filter material 303. The hollow tube 301 has an outer diameter 307 and an inner diameter 309. The filter 103" further comprises a flow restrictor in the form of bead 305. In the embodiment of FIG. 3, the flow restricting bead 305 comprises air-impermeable material. The flow restricting bead 305 is substantially spherical, with a diameter 311. The flow restricting bead 305 is disposed in the hollow tube 301. Diameter 311 of the flow restricting bead 305 is slightly larger than inner diameter 309 of the hollow tube 301, so the flow restricting bead 305 causes the filter material adjacent the bead 305 to distort slightly and the flow restricting bead 305 is retained in the hollow tube 301 by friction.

The filter 103" further comprises a filter plug 313 and an additional hollow tube 315. The hollow tube 301, filter plug 313 and additional hollow tube 315 are axially aligned in an end-to-end relationship. In FIG. 3, the filter plug 313 is upstream of the hollow tube 301 and the additional hollow tube 315 is downstream of the hollow tube 301. The filter plug 313 may comprise any suitable filter material. The additional hollow tube 315 may comprise any suitable material, for example paper or filter material. As shown schematically by the arrows, air drawn through the filter 103" during use of the smoking article is forced to flow around the flow restricting bead 305 and through a reduced cross section of filter material 303 of the hollow tube 301. Because the filter 103" is open at the mouth end, thereby forming a mouth end cavity, visible staining of the mouth end is reduced. The filter may be manufactured by inserting the flow restricting bead 305 into the hollow tube 301, then assembling the hollow tube 301 adjacent the filter plug 313 and additional hollow tube 315.

In FIG. 3, the outer diameter 207 of the hollow tube 301 is 7.7 mm, the inner diameter 209 of the hollow tube 301 is 5.3 mm, the diameter of the flow restricting bead 305 is 6.0 mm, the length of the whole filter 103" is 27 mm, the length of the filter plug 313 is 9 mm, the length of the hollow tube 301 is 8 mm, the length of the additional hollow tube 315 is 10 mm, and the centre of the flow restricting bead 305 is 14 mm from the tubular mouth end of the filter 103" and 4 mm from the downstream end of the hollow tube 301. When the filter is circumscribed by tipping material, the diameter of the filter may be 7.73 mm.

In FIG. 3, the filter includes additional filter elements both upstream and downstream of the hollow tube 301. However, it will be appreciated that an additional element may be included only downstream of the hollow tube 301 or only upstream of the hollow tube 301. Alternatively, no additional filter elements may be provided, as shown in FIG. 2. In addition, in FIG. 3, the upstream additional filter element comprises a plug of filter material. However, any suitable filter element, including but not limited to a disc of filter material and a hollow tube, may alternatively be provided upstream of the hollow tube 301. Similarly, in FIG. 3, the downstream additional filter element comprises a hollow tube. However, any suitable filter element, including but not limited to a plug of filter material or a disc of filter material, may alternatively be provided downstream of the hollow tube 301.

When either the filter 103' of the FIG. 2 or the filter 103" of FIG. 3 is incorporated into a smoking article like that shown in FIG. 1, preferably the perforations 117 are at least about 1 mm downstream of the flow restricting bead 205, 305. The combination of the ventilation provided by the perforations 117, the flow restricting bead 205, 305 and the filter material 203, 303 of the hollow tube provides the desired RTD.

The invention claimed is:

1. A filter for a smoking article, the filter comprising:

a hollow tube of filter material, the hollow tube having an outer diameter and an inner diameter; and a flow restrictor disposed in the hollow tube, wherein at least one cross sectional dimension of the flow restrictor, in a direction perpendicular to the longitudinal axis of the hollow tube, is larger than the inner diameter of the hollow tube such that the flow restrictor engages with the hollow tube to retain the flow restrictor in the hollow tube, wherein the at least one cross sectional dimension of the flow restrictor is between about 70% and about 80% of the outer diameter of the hollow tube, wherein the flow restrictor is configured to divert flow of smoke between the flow restrictor and the outer diameter of the hollow tube, wherein the filter forms a mouth end cavity, and wherein the flow restrictor is substantially spherical and includes at least one air flow channel, the at least one cross sectional dimension of the flow restrictor being a diameter of the spherical flow restrictor.

2. The filter according to claim 1, wherein the inner diameter of the hollow tube is between about 75% and about 99% of the at least one cross sectional dimension of the flow restrictor.

3. The filter according to claim 2, wherein the inner diameter of the hollow tube is between about 80% and about 95% of the at least one cross sectional dimension of the flow restrictor.

4. The filter according to claim 1, wherein the flow restrictor has a compressive yield strength greater than about 8.0 kPa.

5. The filter according to claim 1, wherein the flow restrictor has a compressive strength at a deformation of 10% greater than about 50.0 kPa.

6. The filter according to claim 1, further comprising a filter wrapper circumscribing at least the hollow tube of filter material.

7. The filter according to claim 1, wherein the centre of the flow restrictor is at least about 6 mm from the mouth end of the filter.

8. The filter according to claim 1, further comprising a filter plug disposed upstream of the hollow tube of filter material, and an additional hollow tube disposed downstream of the hollow tube of filter material.

9. A smoking article, comprising:

a tobacco rod; and a filter, comprising a hollow tube of filter material, the hollow tube having an outer diameter and an inner diameter; and a flow restrictor disposed in the hollow tube, wherein at least one cross sectional dimension of the flow restrictor, in a direction perpendicular to the longitudinal axis of the hollow tube, is larger than the inner diameter of the hollow tube such that the flow restrictor engages with the hollow tube to retain the flow restrictor in the hollow tube, wherein the at least one cross sectional dimension of the flow restrictor is between about 70% and about 80% of the outer diameter of the hollow tube, wherein the flow restrictor is configured to divert flow of smoke between the flow restrictor and the outer diameter of the hollow tube, wherein the filter forms a mouth end cavity, and wherein the flow restrictor is substantially spherical and includes at least one air flow channel, the at least one cross sectional dimension of the flow restrictor being a diameter of the spherical flow restrictor.

10. The smoking article according to claim 9, further comprising tipping material attaching the tobacco rod and the filter, the tipping material including a ventilation zone comprising perforations through the tipping material.

11. The smoking article according to claim 10, wherein the tipping material includes at least one circumferential row of perforations at least about 1 mm downstream of the centre of the flow restrictor.

12. The smoking article according to claim 9, further comprising a filter plug disposed upstream of the hollow tube of filter material, and an additional hollow tube disposed downstream of the hollow tube of filter material.

13. A flow restrictor to restrict air flow in a filter for a smoking article, wherein the flow restrictor is disposed in a hollow tube of filter material having an outer diameter and an inner diameter, wherein at least one cross sectional dimension of the flow restrictor, in a direction perpendicular to the longitudinal axis of the hollow tube, is larger than the inner diameter of the hollow tube such that the flow restrictor engages with the hollow tube to retain the flow restrictor in the hollow tube, wherein the at least one cross sectional dimension of the flow restrictor is between about 70% and about 80% of the outer diameter of the hollow tube, wherein the flow restrictor is configured to divert flow of smoke between the flow restrictor and the outer diameter of the hollow tube, wherein the filter forms a mouth end cavity, and wherein the flow restrictor is substantially spherical and includes at least one air flow channel, the at least one cross sectional dimension of the flow restrictor being a diameter of the spherical flow restrictor.

14. The flow restrictor according to claim 13, wherein the flow restrictor is disposed in the hollow tube of filter material between a filter plug disposed upstream of the hollow tube of filter material, and an additional hollow tube disposed downstream of the hollow tube of filter material.

* * * * *